US010939505B2

(12) United States Patent
Wegener et al.

(10) Patent No.: US 10,939,505 B2
(45) Date of Patent: Mar. 2, 2021

(54) ELECTRICAL HEATING SYSTEM FOR A MOTOR VEHICLE

(71) Applicant: WEBASTO SE, Stockdorf (DE)

(72) Inventors: Fritz Wegener, Gilching (DE); Daniel Eckert, Stockdorf (DE); Thorsten Kabelitz, Munich (DE); Karl Goettl, Rosenheim (DE)

(73) Assignee: WEBASTO SE, Stockdorf (DE)

( * ) Notice: Subject to any disclaimer, the term of this patent is extended or adjusted under 35 U.S.C. 154(b) by 31 days.

(21) Appl. No.: 14/406,617

(22) PCT Filed: Jun. 5, 2013

(86) PCT No.: PCT/EP2013/061610

§ 371 (c)(1),
(2) Date: Dec. 9, 2014

(87) PCT Pub. No.: WO2013/186106

PCT Pub. Date: Dec. 19, 2013

(65) Prior Publication Data

US 2015/0163863 A1 Jun. 11, 2015

(30) Foreign Application Priority Data

Jun. 13, 2012 (DE) ..... 10 2012 209 936.0

(51) Int. Cl.
*H05B 3/26* (2006.01)
*H05B 1/02* (2006.01)

(52) U.S. Cl.
CPC ..... *H05B 3/26* (2013.01); *H05B 1/0236* (2013.01); *H05B 3/262* (2013.01);
(Continued)

(58) Field of Classification Search
CPC . H05B 3/00; H05B 3/84; H05B 3/324; H05B 3/845; H05B 3/16; H05B 2203/036;
(Continued)

(56) References Cited

U.S. PATENT DOCUMENTS 2,504,335 A * 4/1950 Jonker ..... H01J 1/20 219/538
3,225,321 A * 12/1965 Walter ..... H05B 3/00 174/76

(Continued)

FOREIGN PATENT DOCUMENTS

CA 2476202 C 8/2003
CN 201945034 U 8/2011

(Continued)

OTHER PUBLICATIONS

WO 2011/085915 A1, "Electrical Heating Element," Rohling, Jul. 2011, translation of descr.*

(Continued)

*Primary Examiner* — Joseph M. Pelham
(74) *Attorney, Agent, or Firm* — Quarles & Brady LLP

(57) ABSTRACT

The invention relates to an electrical heating device (10) for a motor vehicle with a heating resistor designed as a conductor track (12) on a substrate (20), wherein the conductor track is at least partially arranged in a bifilar format. The invention further relates to a motor vehicle having such an electrical heating system.

16 Claims, 3 Drawing Sheets

(52) U.S. Cl.
CPC .. *H05B 2203/003* (2013.01); *H05B 2203/013* (2013.01); *H05B 2203/023* (2013.01)

(58) Field of Classification Search
CPC .. H05B 2203/029; H05B 3/262; H05B 3/265; H05B 3/267; H05B 3/002; B60H 1/2225; B62D 1/065; F24D 13/024; F25D 21/04; B23K 3/0353; F01N 3/2026
USPC ..... 219/201–204, 211–213, 217–219, 236, 219/539, 552, 543; 392/438, 439
See application file for complete search history.

(56) References Cited

U.S. PATENT DOCUMENTS

| | | | | | |
|---|---|---|---|---|---|
| 3,539,767 | A * | 11/1970 | Eisler | H05B 3/26 | 219/213 |
| 3,678,249 | A * | 7/1972 | Lennox | H05B 3/48 | 219/523 |
| 3,883,719 | A * | 5/1975 | Hurko | H05B 3/748 | 219/452.12 |
| 4,095,228 | A * | 6/1978 | Meinke | H01Q 1/52 | 219/203 |
| 5,218,185 | A * | 6/1993 | Gross | H05B 6/34 | 219/212 |
| 6,043,467 | A * | 3/2000 | Little | H05B 1/0269 | 219/542 |
| 6,907,796 | B2 * | 6/2005 | Bremer | G01N 30/12 | 219/628 |
| 7,123,825 | B2 | 10/2006 | Abbott | | |
| 7,329,843 | B2 * | 2/2008 | Bikhovsky | A61F 7/007 | 219/528 |
| 2002/0040901 | A1 * | 4/2002 | Laken | A47J 36/2483 | 219/544 |
| 2003/0044173 | A1 * | 3/2003 | Natsuhara | F24H 1/102 | 392/479 |
| 2003/0230565 | A1 * | 12/2003 | Bikovsky | A61F 7/007 | 219/528 |
| 2005/0035110 | A1 * | 2/2005 | Petrenko | A63C 1/30 | 219/482 |
| 2007/0133964 | A1 | 6/2007 | Natsuhara et al. | | |
| 2008/0223841 | A1 * | 9/2008 | Lofy | H05B 3/16 | 219/202 |
| 2011/0290784 | A1 * | 12/2011 | Orawetz | B64D 15/12 | 219/486 |
| 2014/0070054 | A1 * | 3/2014 | Burton | B64D 15/12 | 244/134 D |
| 2014/0217086 | A1 * | 8/2014 | Bytzek | H05B 3/26 | 219/478 |
| 2015/0219706 | A1 * | 8/2015 | Loftus | B60L 3/0069 | 324/503 |
| 2016/0205726 | A1 * | 7/2016 | Spielmann | H05B 3/12 | 219/543 |

FOREIGN PATENT DOCUMENTS

| | | | | |
|---|---|---|---|---|
| DE | 2552049 | A1 | 5/1977 | |
| DE | 3545454 | A1 | 7/1987 | |
| DE | 102005026496 | A1 * | 7/2006 | H05B 3/267 |
| DE | 102007019891 | A1 | 11/2008 | |
| DE | 102015108580 | A1 * | 12/2016 | H05B 3/262 |
| EP | 0337230 | A2 | 10/1989 | |
| EP | 0495770 | A1 | 7/1992 | |
| GB | 2484321 | A | 4/2012 | |
| WO | 2011085915 | A1 | 7/2011 | |

OTHER PUBLICATIONS

DE-102005026496-A1, Jul. 2006, Mueller, partial translation.*
PCT International Search Report and Written Opinion, PCT/EP2013/061610, dated Sep. 18, 2013, 20 pages.
PCT International Preliminary Report on Patentability, PCT/EP2013/061610, dated Dec. 16, 2014, 9 pages.

* cited by examiner

ELECTRICAL HEATING SYSTEM FOR A MOTOR VEHICLE

CROSS-REFERENCE TO RELATED APPLICATIONS

This application represents the national stage entry of PCT International Application No. PCT/EP2013/061610 filed Jun. 5, 2013, which claims the benefit of German Patent Application 10 2012 209 936.0 filed Jun. 13, 2012, both of which are hereby incorporated herein by reference for all purposes.

The present invention relates to an electrical heating device for a motor vehicle and also to a corresponding motor vehicle.

Electrically operated heating devices are frequently used to heat motor vehicles, in particular to heat interior spaces of a motor vehicle, in particular in electric vehicles. Heating devices of this type can output a considerable amount of electromagnetic interference that can be reduced in a variety of ways. In addition, the operating life of the heating device is shortened if non-uniform temperature and current distributions can occur by way of a heating resistor that is used.

One object of the present invention is to provide an electrical heating device for a motor vehicle having a long operating life and good heating performance.

This object is achieved by means of the features of the independent claims.

Further advantageous embodiments and developments of the invention are evident in the dependent claims.

The description relates to an electrical heating device for a motor vehicle. The heating device comprises a heating resistor that is embodied as a conductor track on a substrate, wherein the conductor track is arranged at least in part in a bifilar manner. As a result of the bifilar arrangement, the conductor track on the one hand can to a large extent cover a surface, which is provided by means of the substrate, leaving only a small area uncovered. On the other hand, the bifilar arrangement renders it possible to minimize possible radiated interference caused by the heating device. A bifilar arrangement of the conductor track can mean that a heating resistor that is embodied as a continuous conductor track is arranged at least in part in such manner that in each case current is flowing or can flow in an opposing direction through part sections of the conductor track that lie adjacent to one another. Part sections that are arranged in such a bifilar manner can be part sections that are provided to heat the substrate. In particular, essentially all the sections of the conductor track that are provided for heating purposes can be part of the bifilar arrangement. As a consequence, the electromagnetic fields that are generated can at least in part cancel one another out. It can be provided that the conductor track can comprise one or more additional regions that are not arranged in a bifilar manner, by way of example connecting regions, in addition to one or more sections or regions that are arranged in a bifilar manner. The conductor track and/or heating device can comprise a first and a second connector and it is possible in each case to connect poles of a voltage supply to said connectors. The conductor track can be routed or arranged between the connectors in an essentially bifilar manner. A substrate can comprise a solid body structure on which it is possible to arrange the conductor track, where necessary by means of using one or more intermediate layers. The conductor track can generally be arranged on or attached to the substrate by means of a suitable deposition method, for instance a printing method, a plasma method or an injection molding or casting method.

The conductor track can be produced from a conductive material, in particular from a metal material, for instance a nickel-chrome alloy. It is feasible that the conductor track is embodied from a non-ceramic material. The substrate can comprise a material that has good heat-conducting characteristics, for instance a metal or metal alloy. By way of example, the substrate can be produced by means of a pressure die casting method. In particular, it can be provided that the substrate is embodied as a heat exchanger for the heat that is generated by means of the heating resistor. Accordingly, the substrate can be provided on a face that lies opposite the heating resistor with channels for a medium that is to be heated, for instance a fluid, in particular water or air. By way of example, the substrate can be embodied from aluminum. At least one intermediate layer can be provided between the substrate and the conductor track and said intermediate layer can be embodied as an adhesive layer and/or an electrically insulating layer. The intermediate layer can be fastened to the substrate and/or can be materially bonded to said substrate. In particular, if the substrate is embodied from an electrically conductive material, an electrically insulating intermediate layer can be provided. By way of example, the intermediate layer can be an aluminum oxide layer. The conductor track can be attached to the intermediate layer or directly to the substrate. An adhesive layer can be provided to fasten the conductor track to the substrate. Intermediate layers can in general comprise a material that has good heat-conducting characteristics. In order to produce the conductor track, it is feasible to attach a continuous layer to the substrate or to an intermediate layer, said continuous layer being embodied from the material of the conductor track. The structure of the conductor track can then be produced by means of suitably treating the continuous layer, for instance by means of a laser treatment process and/or an etching process. In particular, insulating regions that can render it possible to electrically insulate sections of the conductor track with respect to one another can be cut out or cut away by means of a treatment process. Electrically insulating material can be received and/or arranged in insulating regions. The conductor track can comprise a width of a few millimeters, in particular a width of 2.5 mm to 5 mm. The height of the conductor track can amount to 5 μm to 20 μm, in particular between 10 μm and 15 μm on the substrate. The connectors of the conductor track can be arranged adjacent to one another on the same face of the substrate and/or facing the same face of the substrate. The conductor track and/or the heating device can in general be embodied so as to convert electrical current into heat.

It is feasible that the heating device is a high voltage device. In particular, the heating device can be embodied so as to be operable in the case of a supply voltage of a few hundred volts, in particular between 150 V and 650 V, 200 V and 600 V or in a region that lies between these values. An operating voltage region of this type means that the heating device is particularly well suited especially for the operation in an electric vehicle.

In the case of a further development, it can be provided that the conductor track is divided by means of at least one path insulating region at least in part into at least two heating paths that are insulated with respect to one another. The insulation of the heating paths with respect to one another can be provided in particular along a length of the conductor track. It is feasible that the conductor track is not divided over its entire length into multiple heating paths that are insulated with respect to one another. On the contrary, it is possible to divide the conductor track in sections into heating paths that are insulated with respect to one another. Heating paths that are insulated with respect to one another are provided so as to allow current to flow through in the same direction. It can be provided that heating paths that are insulated with respect to one another are heating paths that are electrically connected to one another in parallel. A path insulating region can be formed, as in the above mentioned insulating regions, in general by means of a gap between the conductor tracks and/or can be formed by means of an electrically insulating material that is received in the gap. In particular, it can be expedient to produce path insulating regions by means of a laser treatment process and/or an etching process between the conductor tracks. Where necessary, the regions that have been processed by means of laser treatment or etching can be filled with a suitable insulating material.

It can be provided that a wider insulating region is provided in the region of a conductor track deflection into the opposing direction. In particular, the insulating region can be wider in comparison to an insulating region that leads to a conductor track deflection. As a consequence, it can be ensured that as far as possible the full width of the conductor track is used for the current flow even in a deflecting region into the opposing direction. This avoids the possibility of regions forming that are particularly well supplied with current and regions that are poorly supplied with current in the edge area of the conductor track. In general, a deflection into the opposing direction can mean the conductor track is routed in such a manner that the current flows in reverse. A deflection into the opposing direction can essentially be embodied without straight sections. It is preferred that further deflections of less than 180°, in particular of 90°, are provided that can be mutually connected by means of straight conductor track sections. In general, deflections can represent rounded regions of the conductor track that connect straight conductor tracks to one another. The straight conductor track sections can essentially be aligned orthogonally with respect to one another and/or can be arranged with respect to a current flow in the opposing direction.

It can be provided that the conductor track comprises precisely two deflections in the opposing direction. As a consequence, with regard to the current distribution, over the width of the conductor track, particularly critical deflections into the opposing direction can be avoided as far as possible which ensures a uniform current distribution and heat distribution on the conductor track.

The conductor track can be routed in such a manner that straight sections of the conductor track that have current that is flowing in opposing directions are arranged adjacent to one another. This produces a particularly good behavior for avoiding radiated interference.

The conductor track can be arranged in particular in a spiral or coil-shaped manner. The spiral or coil-shaped arrangement can comprise straight conductor track sections that are connected to other straight sections by way of deflections. The spiral or coil-shaped arrangement can extend in particular between two connecting regions by way of a region that is provided for heating purposes. It can be provided that the spiral or helical shaped arrangement of the conductor track essentially entirely covers the region that is provided for heating purposes and/or the substrate, wherein regions that are not covered by means of the conductor track can be embodied essentially as insulating regions.

In particular, the conductor track can comprise straight sections that are mutually connected by means of the deflections. The deflections can represent or comprise rounded corners.

It can be provided that the conductor track is covered by an insulating layer. The insulating layer can by way of example comprise air or be formed by means of a suitable insulating material. The heating device can be received in a housing and in particular can comprise a lid. The insulating layer can be arranged between the conductor track and the lid or a delimiting wall of the housing.

In addition, the invention relates to a motor vehicle having a heating device that is described herein. The motor vehicle can in particular be an electric vehicle or a hybrid vehicle. The heating device can be arranged so as to heat water or air in a corresponding water or air circulation system of the vehicle.

In the drawings.

In the case of the description hereinunder of the drawings, like reference numerals describe like or comparable components.

Figure 1:
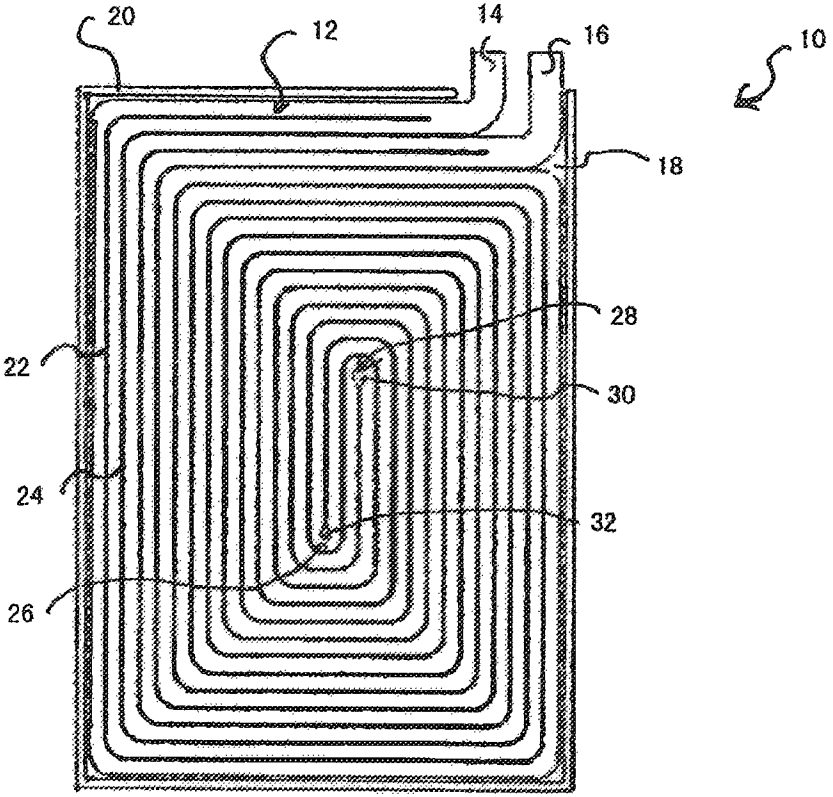
FIG. 1 illustrates a plan view of a conductor track of an electrical heating system for a motor vehicle.

FIG. 1 illustrates a plan view of an electrical heating device 10 for a motor vehicle having a heating resistor that is embodied as a conductor track 12. The heating resistor 12 comprises a first connector 14 and a second connector 16 that are mutually connected by means of the conductor track 12. If a supply voltage is applied to the connectors 14 and 16, the heating resistor that is embodied by means of the conductor track 12 heats up. The conductor track 12 is arranged on an adhesive layer 18 that is arranged on a substrate 20. The adhesive layer 18 is almost entirely covered by means of the conductor track 12 while the substrate 20 is in turn almost entirely covered by the adhesive layer 18. As a consequence, almost the entire substrate is covered by the conductor track 12. This leads to a particularly good use of space and a uniform heat distribution. In this example, the substrate 20 is an aluminum substrate that is embodied as a heat exchanger. As a consequence, heat that is produced by means of the conductor track is dissipated by way of the substrate. The adhesive layer 18 is a layer of aluminum oxide. The conductor track 12 is routed in a spiral or coil-shaped manner having straight sections in a bifilar manner. In particular, conductor track sections that are supplied with a current in opposing directions in each case lie adjacent to one another at the deflection sections and the straight sections. The conductor track is produced by means of a laser method from a nickel-chrome layer that was applied to the adhesive layer 18 by means of a suitable method. In this embodiment, it is provided that the conductor track 12 is divided in the heating region along its length in each case into two part paths by means of a continuous, path-insulating region 22 and said part paths are supplied with current in a parallel manner. It is also feasible that one or more path-insulating regions 22 are only arranged in sections by way of example in the region of deflections or that more than two parallel routed part paths are embodied. In this case, multiple parallel insulating regions can be used. By way of example, the insulating regions can be embodied by means of forming a gap in the conductive material of the conductor track or by means of inserting insulating material in a gap of this type. Sections of the conductor track that have a current that is flowing in opposing directions are in each case electrically insulated with respect to one another by means of an insulating region 24. In FIG. 1, the insulating regions 22 and section-insulating regions 24 alternate in each case as seen from the exterior towards the interior. As is evident in FIG. 1, two deflecting regions 26, 28 are provided in the interior of the helical shape of the conductor track 12 in which the conductor track 12 is deflected in each case into the opposing direction. A wider insulating region 30, 32 is provided in each case in the region of this deflection. These insulating regions 30, 32 are embodied in this case in a drop-shaped manner and compel a current flow in the region of the deflections 26, 28 as far as possible by way of the entire width of the conductor track 12. It is also possible to make the conductor track narrower, in particular to reduce the width of the conductor track rather than widen the insulating region. In addition to the two deflections into the opposing direction, said deflections making it particularly easy to distribute the current in a uniform manner, the conductor track 12 only comprises right-angled deflections. It is fundamentally feasible also to provide a wider insulating region and/or to reduce the width of the conductor track 12 in regions of the right-angled deflections.

Figure 2:
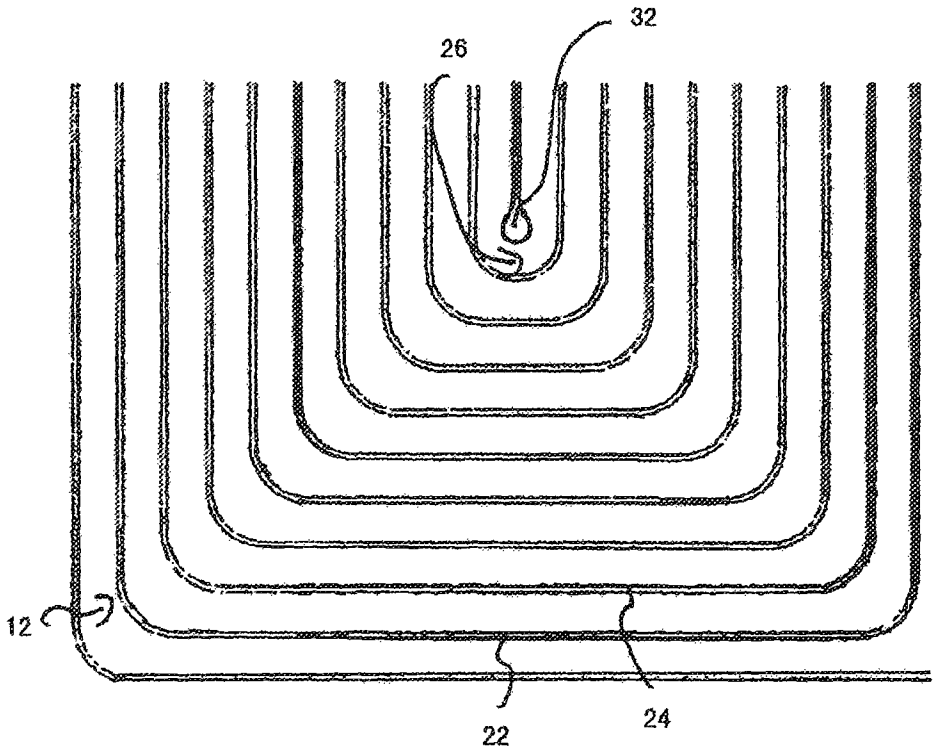
FIG. 2 illustrates an enlarged view of a part region of the conductor track in FIG. 1.

FIG. 2 illustrates an enlarged illustration of a lower region of the electrical heating system in FIG. 1. The deflecting region 26 is particularly evident in which the conductor track 12 is routed into the opposing direction. The drop-shaped form of the insulating region 32 is clearly illustrated in this example in the region of the deflection and said drop-shaped form of the insulating region leads to a uniform current flow around the deflection 26.

Figure 3:
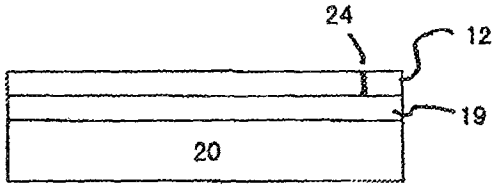
FIG. 3 illustrates schematically an arrangement of the conductor track on a substrate.

FIG. 3 illustrates a cross-sectional view of the heating device 10 in FIGS. 1 and 2 in a view from the right-hand side that corresponds to a view from the direction of the arrow that is illustrated in FIG. 1. The heating device 10 comprises the substrate 20 to which the adhesive layer 18 is attached. The adhesive layer 18 can be electrically insulating and can be produced by way of example by means of oxidation of a metal material of the substrate 20, for instance oxidation of aluminum. The conductor track 12 is arranged on the adhesive layer 18. The conductor track 12 can be applied to the adhesive layer 18 by means of a suitable method, for instance a printing, injection molding, casting or plasma method. An insulating region 24 of the conductor track 12 is evident in this view and said insulating region separates from one another different sections of the conductor track through which current flows in opposite directions.

Insofar as the above description refers to a plasma method, it should be understood that in lieu of this, in general a thermal injection molding method can also be used. The structure of the conductor track that is mentioned in the above description can be produced by means of a printing method. The method that is used to produce the conductor track can potentially be combined with a masking technique in order to further minimize achievable structure widths or rather to accelerate and/or to simplify the production of the structure. By way of example, it is possible in the above description when using a plasma injection molding method to achieve a fine structure having minimal structural widths of approximately 0.5 mm, by way of example a conductor track spacing of approximately 0.5 mm, with the aid of masking tape for a meandering heat conducting layer. It is then potentially possible to omit an additional process of treating the structure using lasers. The height of the conductor track that is described in the above description can expediently amount to 30 μm, preferably between 5 μm to 20 μm and in particular between 10 μm and 15 μm on the substrate. Greater heights/thicknesses of the conductor track by way of example up to 1 mm are of course also possible. The height/thickness of the conductor track can be crucial for setting a cross section of the conductor track in order to establish or rather to influence the resistance of said conductor track. The insulating material that is mentioned in the above description can comprise by way of example silicones and/or polymers or can be embodied from silicones or polymers. The conductor track that is disclosed in the above description can also be embodied from an electrically conductive ceramic material. By way of example, a conductive ceramic material of this type can comprise titanium dioxide ($TiO_2$). The substrate that is disclosed in the above description can also comprise ceramics that have a comparatively high heat-conducting value for ceramics, by way of example $Al_2O_3$ or AlN, or rather mixtures in the form of metal matrix compound materials that can likewise comprise a comparatively high heat-conducting capability. The substrate can alternatively also be embodied from one or more of these basic materials/basic material groups.

The features of the invention that are disclosed in the above description, in the drawings and also in the claims can be fundamental both individually as also in a user-defined combination for implementing the invention.

LIST OF REFERENCE NUMERALS

10 Heating Device
12 Conductor Track
14 First Connector
16 Second Connector
18 Adhesive Layer
20 Substrate
22 Path-Insulating Region
24 Insulating Region
26 Deflecting Region
28 Deflecting Region
30 Insulating Region
32 Insulating Region

The invention claimed is:

1. An electrical heating device for a motor vehicle, said heating device comprising:

a substrate;

a heating resistor on the substrate, wherein the heating resistor being a conductor track arranged on the substrate at least in part in a bifilar manner, wherein a portion of the conductor track is divided into multiple heating paths that are insulated with respect to one another by at least one path-insulating region such that the multiple heating paths that are insulated with respect to one another are electrically connected to one another in parallel and wherein another portion of the conductor track is undivided, and wherein the conductor track includes precisely two deflections.

2. The heating device as claimed in claim 1, wherein the heating device is a high voltage device.

3. The heating device as claimed in claim 1, wherein the conductor track is routed in such a manner that straight sections of the conductor track that have current flowing in opposing directions are arranged adjacent to one another.

4. The heating device as claimed in claim 1, wherein the conductor track is arranged at least in part in a spiral or coil-shaped manner.

5. The heating device as claimed in claim 4, wherein the conductor track includes straight sections that are mutually connected by deflections.

6. The heating device as claimed in claim 1, wherein the conductor track is covered by an insulating layer.

7. A vehicle having a heating device as claimed in claim 1.

8. The heating device as claimed in claim 1, wherein a wider insulating region is provided proximal a conductor track deflection at which the conductor track changes direction into an opposing direction compared to an insulating region proximal a section of the conductor track upstream or downstream of the deflection.

9. An electrical heating device for a motor vehicle, said heating device comprising:

a heating resistor including a conductor track having current flowing therethrough, said conductor track having at least two sections, wherein the current flowing through one of said at least two sections flows in a direction opposite to the current flowing through another of said at least two sections adjacent to said one of said at least two sections, wherein a portion of the conductor track is divided into multiple heating paths that are insulated with respect to one another by at least one path-insulating region such that the heating paths that are insulated with respect to one another are electrically connected to one another in parallel and wherein another portion of the conductor track is undivided.

10. The heating device as claimed in claim 9, in which said conductor track is formed on a substrate dissipating heat generated by the current flowing through said at least two sections.

11. The heating device as claimed in claim 9, wherein the conductor track includes precisely two deflections.

12. The heating device as claimed in claim 9, wherein the conductor track is routed in a bifilar manner.

13. The heating device as claimed in claim 9, wherein the conductor track is arranged at least in part in a spiral or coil-shaped manner.

14. The heating device as claimed in claim 9, wherein a wider insulating region is provided proximal a conductor track deflection joining two of said at least two sections compared to an insulating region proximal a section of the conductor track upstream or downstream of the deflection.

15. The heating device as claimed in claim 8, wherein a narrower conductor track region is provided proximal the deflection compared to a conductor track region distal the deflection.

16. The heating device as claimed in claim 14, wherein a narrower conductor track region is provided proximal the deflection compared to a conductor track region distal the deflection.

* * * * *